US006273679B1

(12) United States Patent
Na

(10) Patent No.: US 6,273,679 B1
(45) Date of Patent: Aug. 14, 2001

(54) CENTRIFUGAL BLOWER

(75) Inventor: Sang-Kwon Na, Seoul (KR)

(73) Assignee: SamSung Electronics Co., Ltd., Suwon (KR)

( * ) Notice: Subject to any disclaimer, the term of this patent is extended or adjusted under 35 U.S.C. 154(b) by 0 days.

(21) Appl. No.: 09/453,169

(22) Filed: Dec. 2, 1999

(30) Foreign Application Priority Data

Jul. 28, 1999 (KR) ..... 99-30810

(51) Int. Cl.[7] ..... F01D 1/02; F03B 1/04
(52) U.S. Cl. ..... 415/204; 415/207
(58) Field of Search ..... 415/204, 205, 415/206, 182.1, 207, 224

(56) References Cited

U.S. PATENT DOCUMENTS 3,824,028 * 7/1974 Zenkner et al. ..... 415/182.1 X
4,143,994 * 3/1979 Yamaguchi ..... 415/205
4,512,716 * 4/1985 Marr et al. ..... 415/205
4,735,551 * 4/1988 Schilling ..... 415/206
5,813,834 * 9/1998 Hopfensperger et al. ..... 415/206

FOREIGN PATENT DOCUMENTS

732579 * 5/1980 (RU) ..... 415/206

* cited by examiner

*Primary Examiner*—John E. Ryznic
(74) *Attorney, Agent, or Firm*—Robert E. Bushnell, Esq.

(57) ABSTRACT

A centrifugal blower comprising a siroco fan having a plurality of blowing fans, and a scroll casing forming a spiral draft passage at an external side of the siroco fan, where a siroco fan is so mounted that spiral centers ($\mathbf{0}_2$,$\mathbf{0}_3$) comprising the draft passage of the scroll casing are detached from a center ($\mathbf{0}_1$) of the siroco fan at a predetermined distance, such that a spiral curve of the scroll casing is simply changed to a non-linear curve to thereby enable to increase a flow rate even at a low revolution of the siroco fan and to reduce noise.

20 Claims, 6 Drawing Sheets

CENTRIFUGAL BLOWER

CLAIM OF PRIORITY

This application makes reference to, incorporates the same herein, and claims all benefits accruing under 35 U.S.C. §119 from an application for CENTRIFUGAL FAN earlier filed in the Korean Industrial Property Office on Jul. 28, 1999 and there duly assigned Ser. No. 30810/1999.

BACKGROUND OF THE INVENTION

1. Field of the Invention

The present invention relates to a centrifugal blower, and more particularly to a scroll casing of a centrifugal blower.

2. Description of the Prior Art

As illustrated in FIG. 1, a centrifugal blower according to the prior art includes a siroco fan 2 having a plurality of fins in peripheral directions, and a scroll casing spirally forming a draft passage at an external side of the siroco fan 2, where air is infused along an axle direction of the siroco fan 2 to form an eddy current in the scroll casing at a 90 degree direction relative to an air intake, to thereby be discharged via a discharge outlet 6.

A spiral of the scroll casing in the conventional centrifugal blower consists of an Archimedean spiral and a logarithmic spiral, where a spiral start point (P1) is situated at an inner side of a spiral chamber (S) from a line connecting a center (O) of the siroco fan 2 and a spiral end point (F1), such that a scroll angle is over 360 degrees.

Furthermore, as illustrated in FIG. 2, the Archimedean spiral is a curved line where a scroll radius (a distance from a center of an siroco fan to a spiral) is linearly increased as a scroll angle (an angle measured from a spiral start point to a spiral end point) is increased, and the logarithmic spiral is a curved line where a scroll radius is linearly and almost straightly increased as a scroll angle is increased.

There is a problem however in that a scroll casing manufactured by utilizing the Archimedean spiral or the logarithmic spiral can easily form a curved line and is easy in manufacturing but eddy current is dispersed at a certain range of a peripheral direction to thereby reduce a blowing efficiency such that performance of a blower is decreased to thereby increase a noise.

In order to complement those problems at the scroll casing manufactured by using the Archimedean spiral or the logarithmic spiral, Japanese laid-open patent No. Hei 6-117397 is disclosed where a spiral is correctively manufactured to have a non-linear shape.

As illustrated in FIG. 3, a spiral of a scroll casing 14 in the Japanese laid-open patent No. Hei 6-117397 constitutes a scroll radius formed in a certain expanded angle from a spiral start point (P2) to an optional scroll angle, ($\theta_1$) where a scroll radius from the scroll angle ($\theta_1$) to a spiral end point (F2) is greater than a scroll radius formed in a predetermined expanded angle from the spiral start point (P2) to the spiral end point (F2), and a scroll radius of the spiral end point (F2) is the same as a scroll radius formed in a predetermined expanded angle from the spiral start point (P2) to the spiral end point (F2).

In other words, as illustrated in FIG. 4, when a scroll angle of the spiral start point (P2) is given as O and a scroll angle of the spiral end point (F2) is given as $\theta_2$, a scroll radius of spiral at a scroll casing 14 can be described in the following formula.

$$r(\theta)=r_0+r_1 \exp(n\theta)+R(\theta),$$

where $$R(\theta)=0 \text{ in case of } 0<\theta<\theta_1,$$

and $$R(\theta)=K_1 \sin\{\pi/2\times(\theta-\theta_1)/(\theta-\theta_2)\} \text{ in case of } \theta_1<\theta<\theta_2,$$

and where $r_0$=distance between a peripheral surface of an siroco fan and spiral start point (P2), $r_1$=siroco fan radius, n=expanded angle and $\theta$=a voluntary angle measured on the spiral start point (P2).

A solid line in FIG. 4 represents a scroll radius formed in a predetermined expanded angle from the spiral start point (P2) to the spiral end point (F2), and a dotted line defines a scroll radius from the voluntary scroll angle ($\theta_1$) to the scroll angle ($\theta_2$) at the spiral end point. Furthermore, the spiral start point (P2) moves towards external side of the spiral chamber (S) on a line connecting the center (0) of the siroco fan 12 to the spiral end point (F2). The range of the scroll angle is below 360 degrees.

However, there is a problem in the scroll casing according to the Japanese laid open patent No. Hei 6-117397 in that it is very difficult to manufacture same in accurate non-linear curve according to the numerical formula. There is another problem in that frictional resistance between airs and between inner surfaces of scroll casing is not much reduced to decrease a blowing efficiency and performances of a blower and to thereby increase a noise.

SUMMARY OF THE INVENTION

The present invention is disclosed to solve the aforementioned problems and it is an object of the present invention to provide a centrifugal blower capable of being easily manufactured and having a higher blowing efficiency but with less noise.

In accordance with the object of the present invention, there is provided a centrifugal blower, the blower comprising:

a siroco fan having a plurality of blowing fans; and a scroll casing forming a spiral draft passage at an external side of the siroco fan, where, the siroco fan is so mounted as to allow centre of the siroco fan to be detached at a predetermined distance from centre of a spiral comprising the draft passage of the scroll casing.

The spiral of the scroll casing is an Archimedean spiral or an logarithmic spiral.

A scroll start point and scroll end point of the scroll casing are situated on a same line, such that a scroll angle varies from zero (0) degree to 360 degrees but the scroll angle can be ranged below 360 degrees or above 360 degrees.

The centre of the siroco fan is moved from a spiral centre of the scroll casing towards an opposite direction of the scroll start point. However, it should be noted that the centre of the siroco fan may be variably moved horizontally and vertically from the spiral center of the scroll casing to make the spiral of the scroll casing a non-linear scroll curve when viewed from the centre of the siroco fan.

Distance (D) where the centre of the siroco fan is detached from the spiral centre of the scroll casing is preferred to satisfy a formula, $0<D\leqq 0.15\ R_{p3}$, where $R_{p3}$ is a spiral radius of the scroll start point.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Preferred embodiments of the present invention will now be described in detail with reference to the accompanying drawings.

Figure 1:
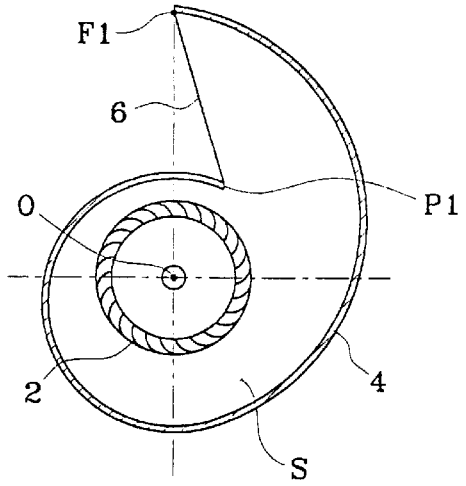
FIG. 1 (PRIOR ART)
FIG. 1 is a schematic sectional view of a centrifugal blower having a linear scroll curve according to the prior art.
Figure 2:
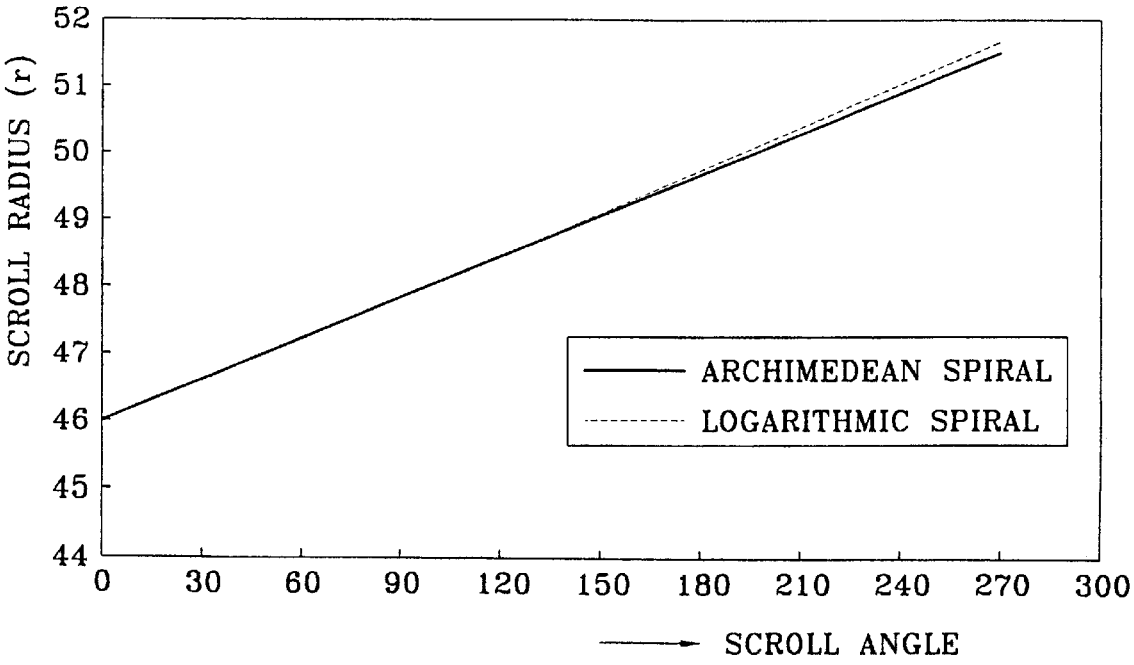
FIG. 2 (PRIOR ART)
FIG. 2 is a graph for illustrating a relation between a scroll radius and a scroll angle in FIG. 1.
Figure 3:
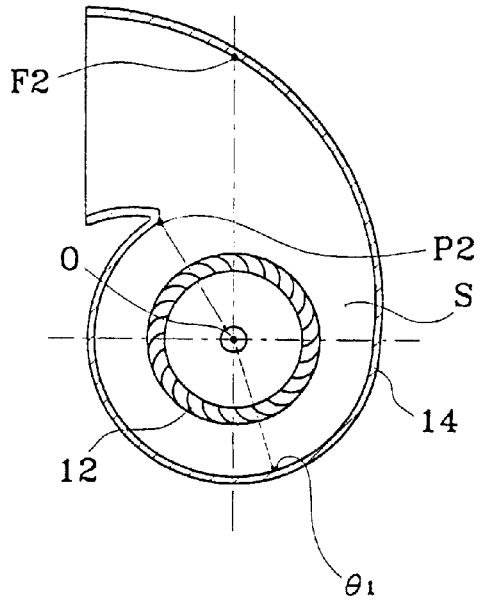
FIG. 3 (PRIOR ART)
FIG. 3 is a schematic sectional view of a centrifugal blower having a non-linear scroll curve according to the prior art.
Figure 4:
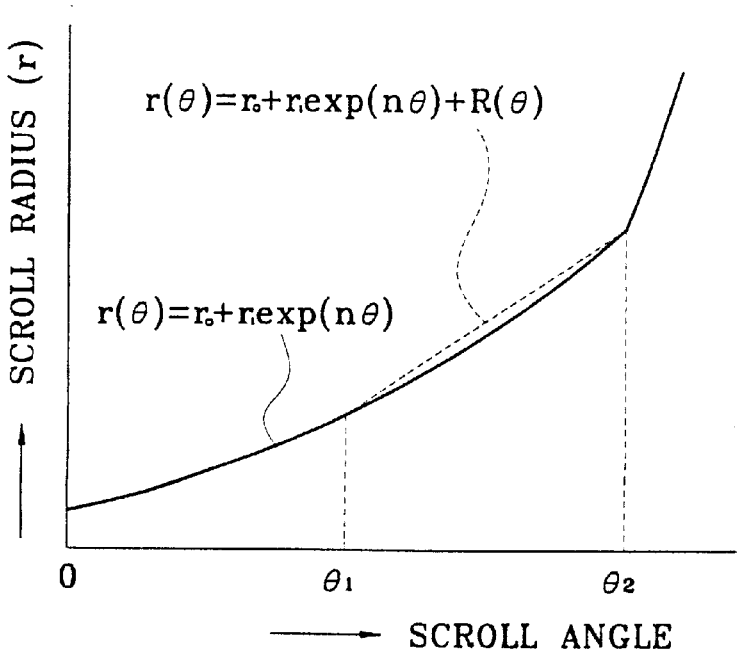
FIG. 4 (PRIOR ART)
FIG. 4 is a graph for illustrating a relation between a scroll radius and a scroll angle in FIG. 3.
Figure 5:
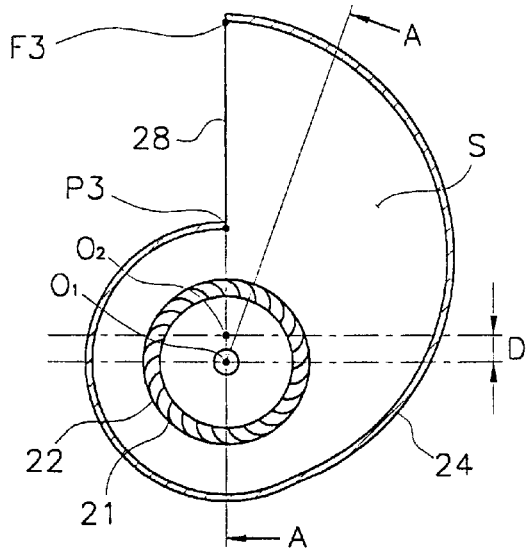
FIG. 5 is a schematic sectional view of a centrifugal blower having a non-linear scroll curve according to a first embodiment of the present invention.
Figure 6:
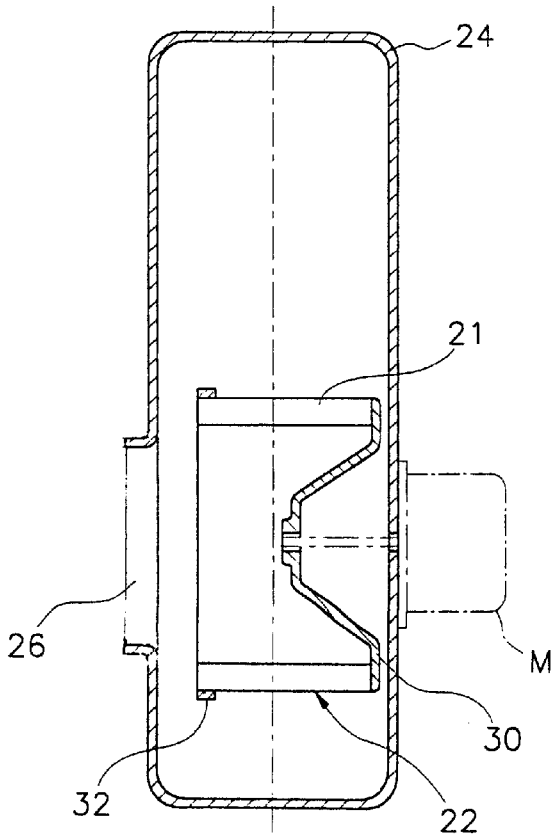
FIG. 6 is a sectional view taken along line A—A in FIG. 5.

As illustrated in FIGS. 5 and 6, an siroco fan 22 having a plurality of fins 21 in peripheral direction is externally provided with a scroll casing 24 forming a spiral draft passage. A center ($\mathbf{0}_1$) of the siroco fan 22 is detached downwards from a spiral center ($\mathbf{0}_2$) of the scroll casing 24 at a predetermined distance (D).

Hereinafter, for the sake of description, a distance from the spiral center ($\mathbf{0}_2$) of the scroll casing 24 to a spiral is to be referred to as "spiral radius" and a distance from the center ($\mathbf{0}_1$) of the siroco fan 22 to the spiral is to be defined as "scroll radius".

The scroll casing 24 is disposed at an axle direction of the siroco fan 22 with an air inlet 26 for infusing the air and at a spiral end point (F3) thereof with an air outlet 28 at a right angle from the air inlet 26. The air infused from the air inlet 26 receives energy from the siroco fan 22, which in turn is increased in its pressure at the spiral start point (P3) to form an eddy current, such that the air now is changed a pressure head into a velocity head at the spiral end point (F3) to thereafter be discharged.

The siroco fan 22 is arranged with a plurality of fins which run along a periphery of a base plate 30 having a centrally bulged shape towards the air inlet, and a periphery at the air inlet side of the fin 21 is connected by a support ring 32 to maintain a cylindrical rigid shape. Furthermore, the base plate 30 at the siroco fan 22 is connected to a motor shaft of a motor (M).

The scroll casing 24 is formed in an Archimedean spiral or in a logarithmic spiral around the center ($\mathbf{0}_2$) of spiral. The Archemedean spiral is a curve which satisfies a numerical formula, $r=r_3+m\theta$ and the logarithmic spiral is a curve satisfying a numerical formula, $r=r_3e^{n\theta}$, where, r=a distance to a spiral from the center ($\mathbf{0}_2$) of the spiral at the scroll casing, $r_3$=a spiral radius at the spiral start point (P3: scroll start point), $\theta$=a scroll angle measured from the spiral start point (P3: scroll start point) towards the spiral end point (F3: scroll end point), and m and n are each a constant.

The scroll start point (P3) and the scroll end point (F3) at the scroll casing 24 are on the same line, such that a scroll angle can vary from zero (0) degree to 360 degrees. However, the scroll start point (P3) can enter an inner side of a spiral chamber (S) on a line connecting the center ($\mathbf{0}_1$) of the siroco fan 22 and the scroll end point (F3) to cause a scroll angle range to go over 360 degrees, or the scroll start point (P3) can be moved to an external side of the spiral chamber (S) on a line connecting the center ($\mathbf{0}_1$) of the siroco fan 22 and the scroll end point (F3) to allow a scroll angle range to stay under 360 degrees.

Distance (D) where the center of the siroco fan is detached from the spiral center of the scroll casing is made to satisfy a formula $0<D\leqq 0.15\ R_{p3}$, where $R_{p3}$ is a spiral radius of the scroll start point.

Figure 7:
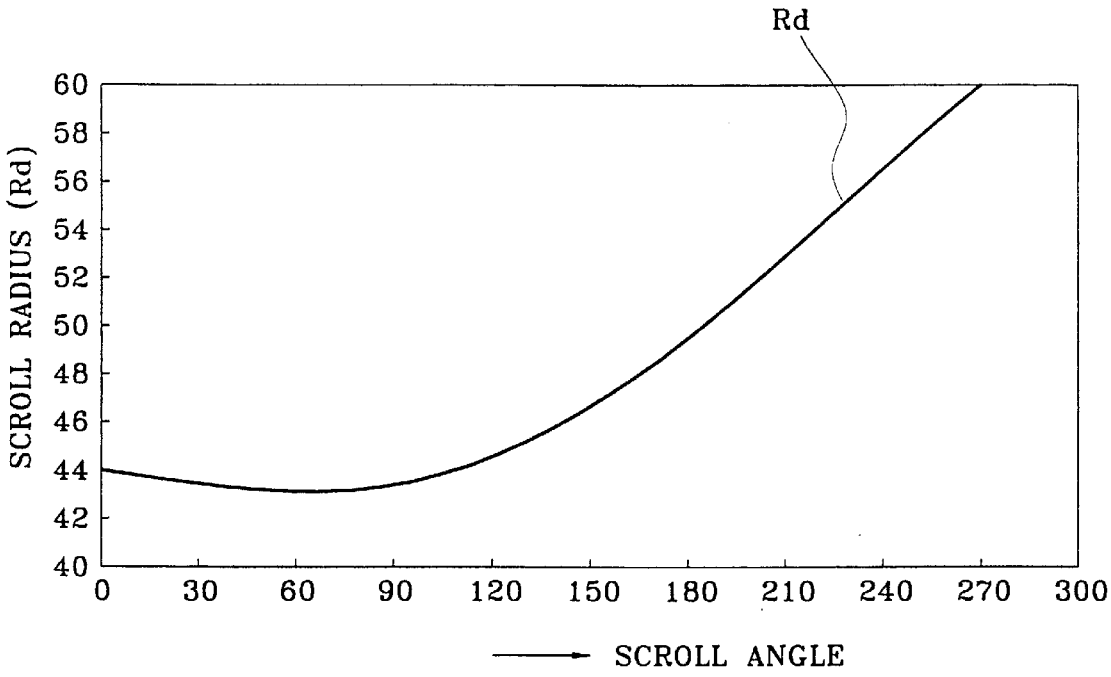
FIG. 7 is a graph for illustrating a relation between a scroll radius and a scroll angle in FIG. 5.

A scroll curve formed by moving downwards the center of siroco fan from the spiral center of the scroll casing is depicted in FIG. 7. In other words, a scroll radius (Rd) around the center ($\mathbf{0}_1$) of the siroco fan 22 is hardly increased near at the scroll start point (P3). Furthermore, a spiral radius around the center ($\mathbf{0}_2$) of spiral is the same as a scroll radius (Rd) in the vicinity of the scroll angle of 150 degrees. The scroll curve is thus described non-linear.

In the scroll curve illustrated in FIG. 7, the distance (D) where the centre of the siroco fan 22 is detached from the spiral center ($\mathbf{0}_2$) of the scroll casing 24 formed in logarithmic spiral is 0.15 times the spiral radius of the scroll start point (P3), however, change of the detached distance can obtain a variety of scroll curves.

As mentioned above, the embodiment having a scroll curve formed by moving downwards the center ($\mathbf{0}_1$) of the siroco fan from the spiral centre ($\mathbf{0}_2$) of the scroll casing has its passage width at the vicinity of the spiral start point (scroll start point) greatly increased to thereby decrease a frictional resistance remarkably during an initial stage, such that blowing efficiency is increased and performance of blower is also enhanced to thereby decrease the noise markedly.

Figure 8:
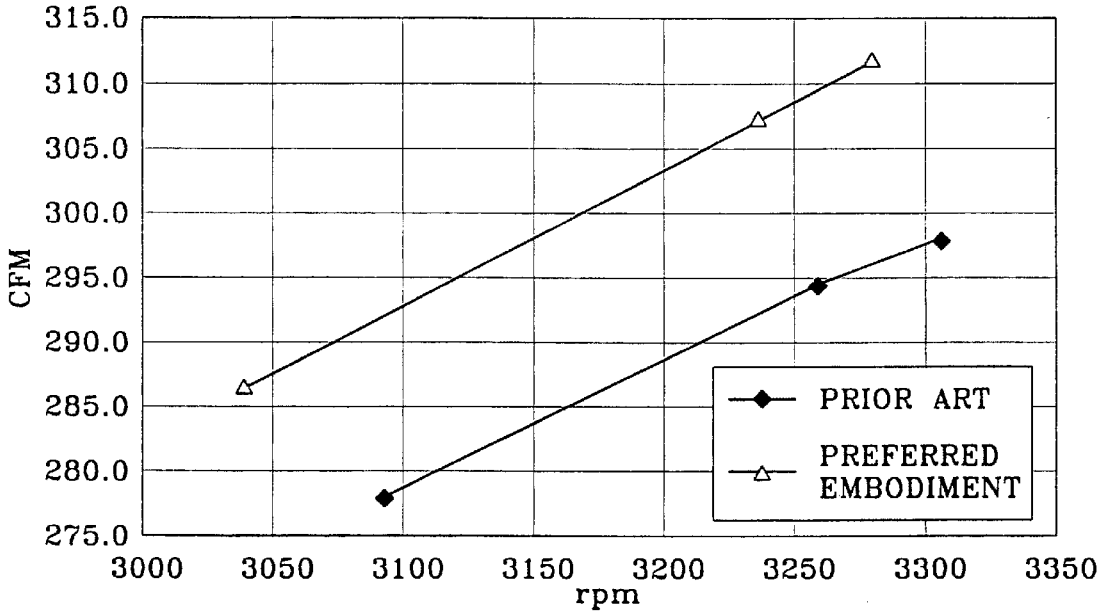
FIG. 8 is a graph of flow rate comparison relative to revolution of a centrifugal blower according to the conventional centrifugal blower and the first embodiment of the present invention.

FIG. 8 is a graph of flow rate comparison between revolution of a centrifugal blower having the conventional logarithmic spiral as scroll curve and a centrifugal blower according to the first embodiment of the present invention having a non-linear scroll curve (the curve in FIG. 7) by moving the center of the logarithmic spiral. As illustrated, flow rate of a centrifugal blower according to the present invention is remarkably greater than that of the conventional centrifugal blower in terms of same revolution.

Figure 9:
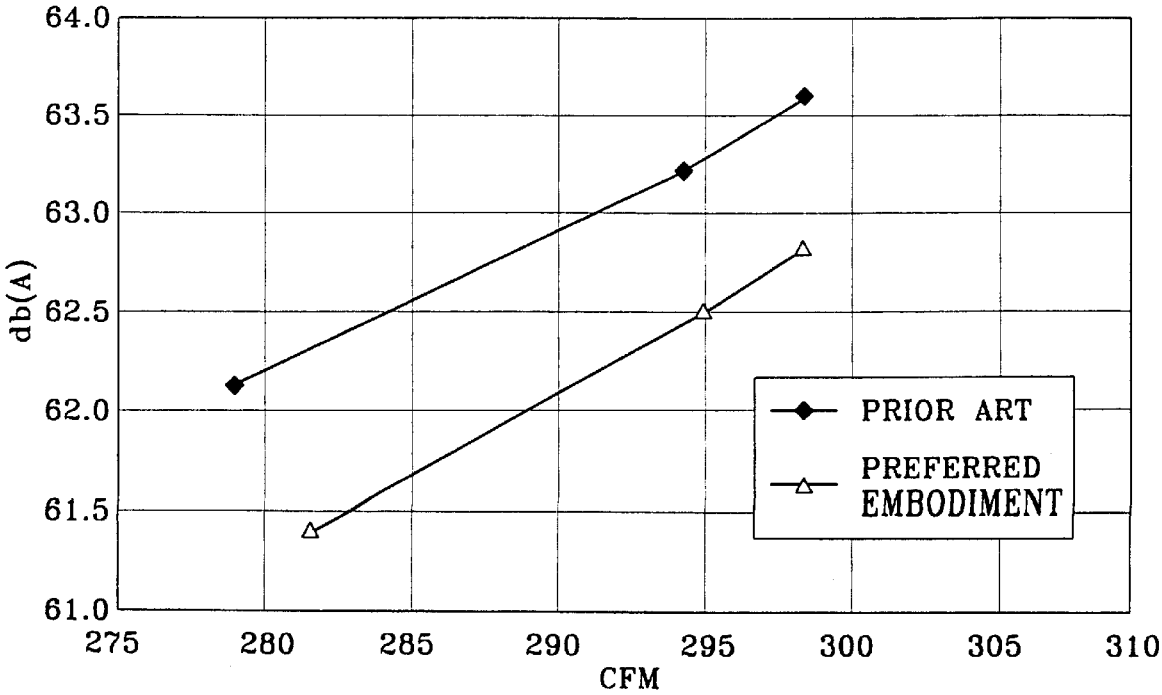
FIG. 9 is a graph of noise comparison relative to flow rate between the conventional centrifugal blower and the first embodiment of the present invention.

FIG. 9 is a graph of noise comparison relative to flow rate between a centrifugal blower having the conventional logarithmic spiral as scroll curve and a centrifugal blower according to the first embodiment of the present invention having a non-linear scroll curve (the curve in FIG. 7) by moving the center of logarithmic spiral, where as illustrated, it can be noted that noise according to the present invention is much more reduced than that of the conventional centrifugal blower in terms of same flow rate.

According to the present invention, low operation can be possible due to higher flow rate at a low revolution to thereby reduce the noise. Furthermore, a scroll casing is manufactured by utilizing logarithmic spiral or Archimedean spiral to thereby make it possible to manufacture a centrifugal blower easily.

Figure 10:
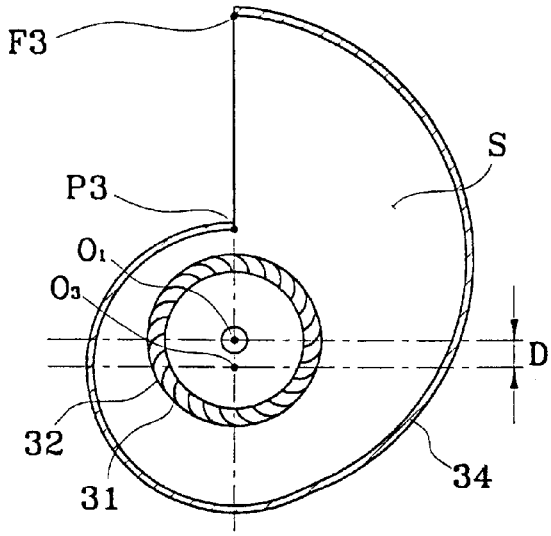
FIG. 10 is a schematic sectional view of a centrifugal blower having a non-linear scroll curve according to a second embodiment of the present invention.
Figure 11:
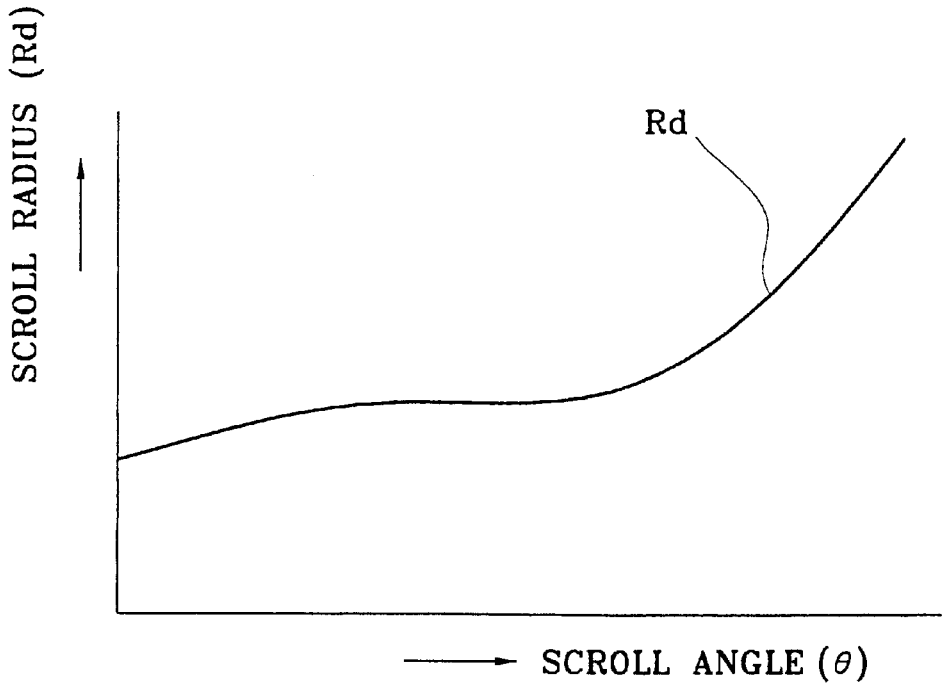
FIG. 11 is a graph for illustrating a relation between a scroll radius and a scroll angel in FIG. 10.

FIG. 10 is a schematic sectional view of a centrifugal blower having a non-linear scroll curve according to a second embodiment of the present invention, where a center ($\mathbf{0}_1$) of a siroco fan 32 is detached upwards at a predetermined distance (D) from the spiral center ($\mathbf{0}_3$) of scroll casing 34. A scroll curve formed by moving upwards the center of the siroco fan from the spiral center of the scroll casing is depicted in FIG. 11, where it can be noted that a scroll radius (Rd) around a center ($\mathbf{0}_1$) of the siroco fan 32 is hardly increased at around the middle of the scroll. It should be also noted that center of the siroco fan is variably moved up and down from the spiral center of the scroll casing to thereby make a non-linear scroll curve when viewed from the center of the siroco fan.

As apparent from the foregoing, there is an advantage in the centrifugal blower according to the present invention in that the centrifugal blower is easy to manufacture, has a higher blowing efficiency and is reduced in noise.

What is claimed is:

1. A blower, comprising:

a fan having a plurality of blades and a fan center; and a casing having a spiral forming a spiral passage around said fan, said spiral having a spiral center spaced-apart from said fan center by a predetermined distance, wherein said spiral of said casing is an Archimedean spiral or an logarithmic spiral.

2. The blower as defined in claim 1, wherein said predetermined distance (D) between said fan center of said fan and said spiral center of said spiral is to satisfy a formula, $0<D\leqq 0.15\ R_{p3}$, where $R_{p3}$ is a spiral radius of a scroll start point of said spiral.

3. The blower of claim 1, wherein said fan is a sirocco fan.

4. The blower of claim 1, wherein a spiral radius between said spiral center and a start point of said spiral is less than a scroll radius between said fan center and said start point of said spiral.

5. The blower of claim 1, wherein a spiral radius between said spiral center and a start point of said spiral is less than a scroll radius between said fan center and said start point of said spiral and is greater than a distance between said spiral center and said fan center.

6. The blower of claim 1, with said spiral comprising a start point located on a straight line passing said fan center and said spiral center.

7. The blower of claim 1, with said spiral comprising an end point located on a straight line passing said fan center and said spiral center.

8. The blower of claim 1, with said spiral of said casing comprising a start point and an end point both located on a straight line passing said fan center and said spiral center.

9. A blower, comprising:

a fan having a plurality of blades and a fan center; and a casing having a spiral forming a spiral passage around said fan, said spiral having a spiral center spaced-apart from said fan center by a predetermined distance, wherein a scroll start point and a scroll end point of said spiral are on the same line such that a scroll angle varies from zero (0) degree to 360 degrees.

10. The blower of claim 9, wherein said predetermined distance (D) between said fan center of said fan and said spiral center of said spiral is to satisfy a formula, $0<D\leqq 0.15\ R_{p3}$, where $R_{p3}$ is a spiral radius of said scroll start point.

11. The blower of claim 9, wherein said fan is a sirocco fan.

12. The blower of claim 9, wherein a spiral radius between said spiral center and a start point of said spiral is greater than a scroll radius between said fan center and said start point of said spiral.

13. The blower of claim 9, wherein said scroll start point is located on a straight line passing said fan center and said spiral center.

14. The blower of claim 9, wherein said scroll end point is located on a straight line passing said fan center and said spiral center.

15. The blower of claim 9, wherein both said scroll start point and said scroll end point are located on a straight line passing said fan center and said spiral center.

16. A blower, comprising:

a fan having a plurality of blades fans and a fan center; and a spiral casing forming a spiral passage around said fan, having a spiral center spaced-apart from said fan center by a predetermined distance, wherein said fan center of said fan is located opposite to a start point of said spiral casing from said spiral center of said spiral casing.

17. The blower of claim 16, wherein said predetermined distance (D) between said fan center of said fan and said spiral center of said spiral casing is to satisfy a formula, $0<D\leqq 0.15\ R_{p3}$, where $R_{p3}$ is a spiral radius of said scroll start point.

18. The blower of claim 16, wherein said fan is a sirocco fan.

19. The blower of claim 16, wherein both said scroll start point and said scroll end point are located on a straight line passing said fan center and said spiral center.

20. The blower of claim 16, wherein said scroll end point is located on a straight line passing said fan center and said spiral center.

* * * * *